United States Patent [19]

Stookey et al.

[11] 4,213,446

[45] Jul. 22, 1980

[54] STOVE DOOR OPERATOR

[76] Inventors: Gary K. Stookey, 5000 Foots Creek Rd., Gold Hill, Oreg. 97526; James F. Jackson, 9711 W. Evans Creek Rd., Rouge River, Oreg. 97537

[21] Appl. No.: 963,400

[22] Filed: Nov. 24, 1978

[51] Int. Cl.[2] ..... F23M 7/00

[52] U.S. Cl. ..... 126/192; 49/78; 126/200; 126/126

[58] Field of Search ..... 126/60, 160, 163 A, 126/163 R, 194, 197, 198, 200, 201, 202, 138-141, 213, 192, 62; 110/176, 181; 49/74, 78, 87, 88

[56] References Cited

U.S. PATENT DOCUMENTS

| | | | |
|---|---|---|---|
| 268,066 | 11/1882 | Lixuxweiler | 126/60 |
| 1,128,364 | 2/1915 | Kase | 126/160 |
| 2,479,773 | 8/1949 | Piehl | 49/88 |
| 2,540,657 | 2/1951 | Crumbaker | 126/60 |
| 3,426,507 | 2/1969 | Kossowski | 49/78 |
| 4,092,976 | 6/1978 | Buckner | 126/202 |
| 4,136,662 | 1/1979 | Willson | 126/200 |

*Primary Examiner*—Samuel Scott
*Assistant Examiner*—G. Anderson
*Attorney, Agent, or Firm*—David L. Garrison; Ford E. Smith

[57] ABSTRACT

A stove for burning combustible materials having a fire box at least in part lined with a fire resistant lining and having an opening across a front surface thereof, said opening defined by a hearth and an upper lip and equipped with pivotally mounted door means mounted for rotation within the stove along horizontally disposed axes so that the opening can be effectively closed by rotation of the upper and lower doors into their closed position. The hearth may be equipped with an upstanding transparent panel to permit viewing of the fire when the doors are open. Access to the fire box for insertion of additional flammable materials is provided by a door means positioned at the end of said fire box. Protection for the transparent panel to prevent logs from rolling against it may be provided by elongated means extending across the front opening at or above the rearward portion of the hearth.

1 Claim, 5 Drawing Figures

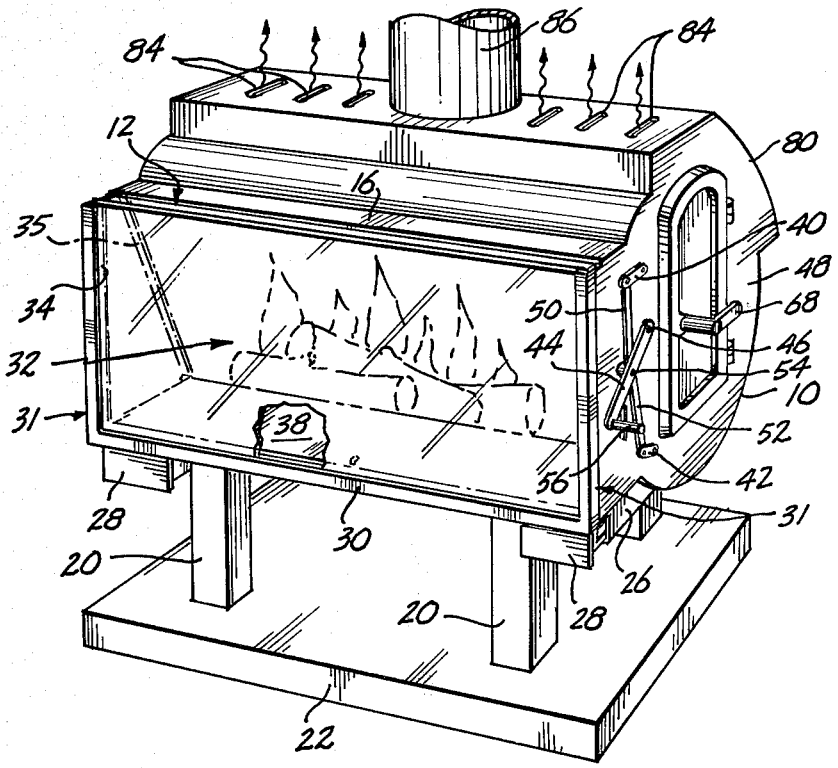
Fig. 1.
Fig. 2.
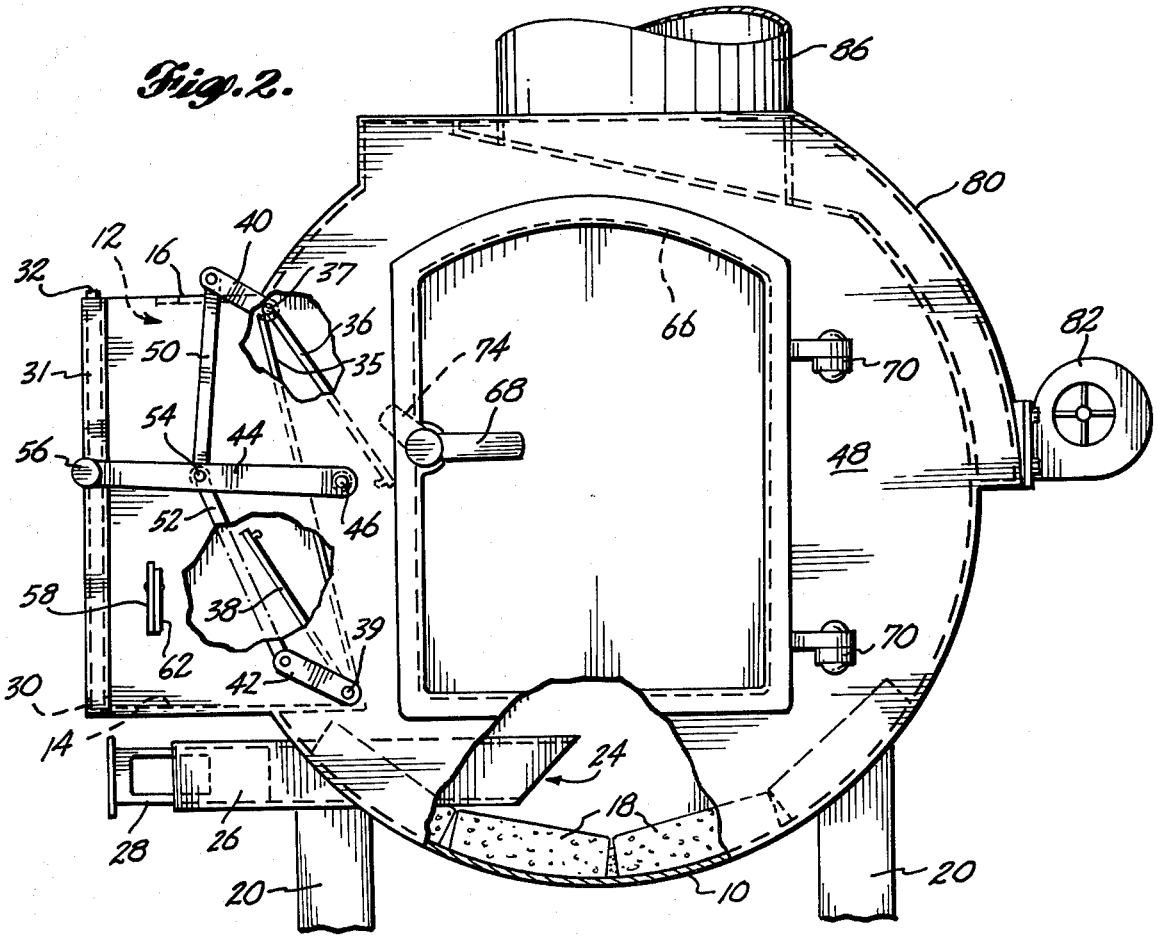

STOVE DOOR OPERATOR

FIELD OF THE INVENTION

This invention relates to wood or coal burning stoves and more particularly to stoves for burning combustible substances having internal doors which may be open for viewing the fire or closed for efficiency during operation of the stove.

PRIOR ART

Wood burning and coal burning fireplaces and stove devices have been well known in the prior art including such devices as Franklin stoves and similar devices. Franklin stoves are provided with a large heat radiating area and have doors which may be opened and closed across the front of the stove fire box. The doors are pivoted about a vertical axis and permit usage of the stove in either the open or closed position of the doors. The doors must be opened to insert additional flammable materials. It is thus difficult to incorporate a transparent panel, such as a glass panel, to close or partially close the opening in such stoves. It is also known to utilize glass panels as the door means in wood burning stoves; however, such structures do not provide the heat radiating characteristics of a metal door nor do they, in prior art presently known to the inventors, provide a secure seal to prevent loss of heat upwardly through the flue duct after the fire is extinguished. In addition, in heretofore known stoves having glass fronts, it has been necessary to provide air entry adjacent the glass to avoid the buildup of soot and carbon thus preventing a secure seal and permitting heated room air to be drawn out through the stove after the fire has burned itself out thus causing a very substantial heat loss.

OBJECTS OF THE INVENTION

It is an object of this invention to provide a stove for burning combustible materials having improved efficiency, safety and versatility in operation.

It is a specific object of this invention to provide a stove for burning wood, coal or other similar combustible materials which may be operated in a fashion with doors open for viewing the combustion or with doors closed to provide maximum heating efficiency, the doors being positioned internally of the stove and operable by an external lever system.

It is a further object of this invention to provide a stove structure having a transparent screen permitting viewing of the combustion with pivotally mounted internal doors which may be closed or open during operation of the stove without interference with the combustion process.

SUMMARY OF THE INVENTION

These and other objects of this invention are accomplished by providing a stove mechanism having a fire box defined by wall means enclosing the combustion area with closable doors fitted into a front opening. The wall means have an opening across the front thereof through which combustible material being consumed may be observed. Preferably a transparent panel such as tempered glass or the like is used to at least partially close the opening. Pivotally mounted upper and lower doors are mounted adjacent the front opening and may be rotated from an open position into a closed position during operation of the stove. The upper and lower pivotally mounted doors have reinforcing and sealing means along the length thereof which serve to seal the doors when closed and prevent entry of air from the room. An access door for inserting combustibles is provided at one end of the fire box. A heating jacket forming a convection type heating chamber surrounds the combustion chamber to enhance convective heat transfer from the stove. A forced air draft may be utilized. The internal pivotally mounted doors are operated by a lever linkage mechanism so that the doors are opened and closed simultaneously. Air inlet means regulating draft air admitted to the combustion chamber is provided at the bottom front of the combustion chamber.

DESCRIPTION OF THE DRAWING

FIG. 1 is a perspective view of the stove of this invention;

FIG. 2 is an end view of the stove of FIG. 1 with portions broken away for convenience of illustration;

DESCRIPTION OF THE PREFERRED EMBODIMENT

Figure 3:
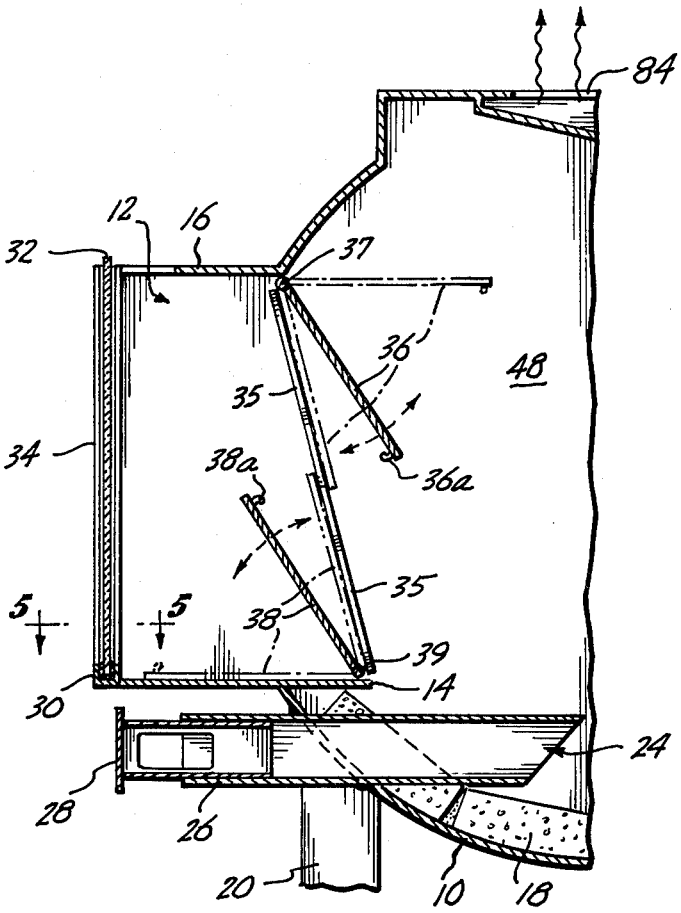
FIG. 3 is a partial transverse sectional view through the front portion of the stove.
Figure 4:
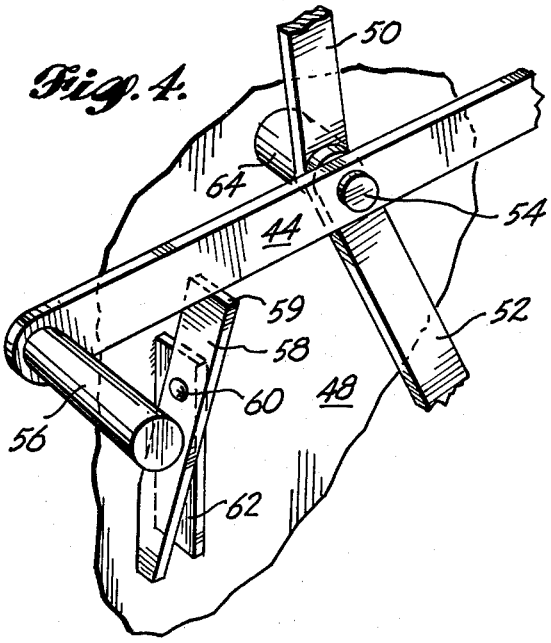
FIG. 4 is a perspective view of the portion of the door closing activator lever.
Figure 5:
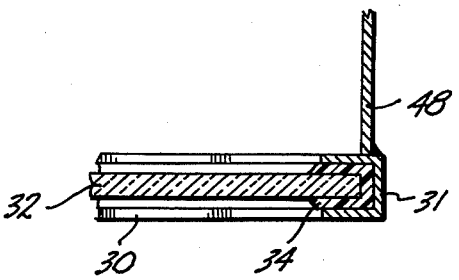
FIG. 5 is a detailed section of an edge portion of the front window.

Referring to FIGS. 1 and 2, it will be seen that the stove herein comprises main wall means 10 generally defining a horizontal cylindrical fire box having an elongated front opening defined by a horizontally disposed hearth ledge 14 and an overhanging lip 16 at the ends of which are the end walls of the stove.

A non-conductive liner formed of heat resistant firebricks 18 forms a base on which a fire may be built and restricts the downward radiation of heat.

The stove is supported above the floor by legs 20 which stand on stove pad 22.

Internally of the fire box at each end is a draft inlet 24 at the inner of a tubular conduit 26. The outer front end of conduit 26 is provided with a forwardly located adjustable side-posted draft drawer 28 by which the amount of air entering the fire box may be manually controlled.

As can be seen in FIG. 3, the front edge of hearth 14 has groove 30, 31 in which the lower edge of transparent window panel 32 is placed. Panel 32 is a piece of heat resistant glass or the like. It is mounted in frame 34. Panel 32 is spaced forwardly from lip 16 to provide an opening 12 for entry of air into the fire chamber to cool panel 32 and keep it clean as can be seen in FIG. 3.

In what may be called the gullet of the elongated front opening is mounted paired doors 36 and 38. Upper door 36 has pivot means 37 at each end that pass through the end walls of the fire box near the rear edge of overhanging lip 16. Lower door 38 is likewise provided with pivot means 39 passing through the firebox end walls adjacent the rear edge of hearth 14. Normally, during use of the stove for heating and comfort, the lower door 38 lies on hearth 14 and upper door 36 stands at an upward angle near the inside of the front upper wall of the fire box so that the fire is visible to persons in the room. When using the stove for maximum heating efficiency (as well as whenever no fire is burning in the stove) the doors assume a closed position as shown in dotted lines in FIG. 3. Doors 36 and 38 are drawn together with seal member 36*a* touching and sealing against door 38 and seal member 38*a* touching and sealing against door 36. Sealing members 36*a* and 38*a* also provide structural rigidity to doors 36 and 38 respectively. When door means 36 and 38 are swung to meet, they substantially close the front opening of the fire box. As the doors swing between their first wide open position toward their second closed position, they automatically shed any fly ash or the like in the direction of the fire and away from the front opening.

Movement of the door means is facilitated by crank arms 40 and 42. Arm 40 is secured to the outward projecting pivot 37 of door 36. Likewise crank arm 42 is secured to the outward projecting pivot 39 of door 38. Actuator lever 44 is pivotally mounted by pin 46 of the end exterior wall 48 of the fire box. Links 50 and 52 pivotally connect between ends respectively of cranks 40 and 42 and centrally mounted pivot pin 54 carried by lever 44. When lever 44 is manually raised by aid of handle 56, the doors 36 and 38 are swung toward the closed position. By depressing lever 44 the doors are swung to their normal open position.

To insure that the doors stay closed, a dog pivot on pin 60 supported by flange 62 on wall 48 may be swung out so that its upper end 59 is disposed under lever 44. Lever 44 is offset from wall 48 by spacer 64.

End wall 48 has an opening 66 for stoking the stove with fuel. Door 68 pivoted on ears 70 closes opening 66 and is manipulated by handle 72 which may carry in conventional manner lug 74 that latches the door closed.

A heat exchange chamber 80 is wrapped in a continguous manner about the upper rear portion of the firebox. A fan 82 induces forced air flow although normal convective forces will cause air to flow through chamber 80 to upper outlets 84. Heat is thus very efficiently extracted from the fire box at the rear and near the base of conduit 80 which forms means for venting away the products of combustion.

What is claimed is:

1. A stove, comprising metallic wall means forming a fire box, said wall means having outlet means for the products of combustion from said fire box;

means forming a non-conductive liner for at least the bottom portion of said fire box said fire box having an elongated front opening defined by a horizontally disposed hearth means, an overhanging lip parallel thereto, and upright end walls, all projecting forwardly of said fire box;

an upper and a lower closable door pivot-mounted at said front opening to pivot about parallel horizontal axes between open and closed positions;

common ends of said upper and lower pivot-mounts outwardly extending through a common end wall of said fire box;

a crank arm secured external of said fire box to said outwardly extending pivot mounts;

a manually operable actuator lever pivotally mounted on said fire box end wall between said crank arms; and a pair of links mutually connected at common ends to said lever and at each opposite end to a crank arm whereby operation of said lever either disposes said doors in a parallel open position or swings said doors to substantial alignment to close said front opening.

* * * * *